US008434162B2

(12) United States Patent
Stachler et al.

(10) Patent No.: US 8,434,162 B2
(45) Date of Patent: May 7, 2013

(54) EYE PROTECTORS

(75) Inventors: Thomas H. Stachler, Dayton, OH (US); Mary I. Grilliot, Dayton, OH (US); William L. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 546 days.

(21) Appl. No.: 12/157,483

(22) Filed: Jun. 11, 2008

(65) Prior Publication Data

US 2009/0307816 A1 Dec. 17, 2009

(51) Int. Cl.
*A61F 9/00* (2006.01)
*A61F 9/02* (2006.01)
*G02C 3/00* (2006.01)

(52) U.S. Cl.
USPC ..... 2/10; 2/453; 351/155

(58) Field of Classification Search ..... 2/410, 5, 2/6.1, 6.2, 6.3, 6.4, 6.5, 6.6, 6.7, 425, 15, 2/10, 12, 13, 9, 209.13, 175.5, 175.6; D29/102, D29/103, 104, 105, 106, 107; D2/865, 866, D2/872, 891, 895; 351/155, 156, 157, 47, 351/48, 57, 58
See application file for complete search history.

(56) References Cited

U.S. PATENT DOCUMENTS 1,298,636 A * 4/1919 Altman ..... 2/10
1,899,905 A * 2/1933 Uhlemann ..... 2/13
2,425,847 A * 8/1947 Humberto ..... 2/10
2,467,448 A * 4/1949 Vaca ..... 2/10
2,481,960 A * 9/1949 Wall et al. ..... 2/10
2,500,280 A * 3/1950 Feldman ..... 2/10
2,533,626 A * 12/1950 Reiter ..... 16/257
2,538,608 A * 1/1951 Vaca ..... 2/10
2,560,669 A * 7/1951 Vaca ..... 2/10
2,640,195 A * 6/1953 Bricker ..... 2/13
2,648,091 A * 8/1953 Jones ..... 16/336
2,677,853 A * 5/1954 Ross ..... 16/235
2,708,270 A * 5/1955 Von Gunten ..... 2/13
2,717,386 A * 9/1955 Linster ..... 2/12
2,998,610 A * 9/1961 Spero ..... 2/13
3,298,032 A * 1/1967 Sielisch ..... 2/13
3,383,155 A 5/1968 Bourke
3,383,707 A * 5/1968 McNeill ..... 2/12

(Continued)

OTHER PUBLICATIONS

Merriam-Webster Online Dictionary, "Molding", Aug. 29, 2012, <http://www.merriam-webster.com/dictionary/molding>, 1 pg.*

(Continued)

*Primary Examiner* — Shelley Self
*Assistant Examiner* — Jane Yoon
(74) *Attorney, Agent, or Firm* — Wood, Phillips, Katz, Clark & Mortimer

(57) ABSTRACT

An eye protector (16) is provided for mounting to a protective helmet (10) of the type worn by a firefighter or other emergency worker. The protective helmet (10) has a brim (14), and the eye protector (16) includes a bracket (20) mounted to the brim (14), a first stop surface (38) carried on the bracket (20), an eye shield (18) attached to the bracket (20) for movement between a storage position extending along the brim (14) and a usage position extending downward from the brim (14) to shield the eye of the wearer, and a second stop surface (37) carried on the eye shield (18) and abutted against the first stop surface (38) with the eye shield (18) in the usage position to limit movement of the eye shield (18) beyond the usage position.

7 Claims, 3 Drawing Sheets

U.S. PATENT DOCUMENTS

| | | | | | |
|---|---|---|---|---|---|
| 3,538,509 | A | * | 11/1970 | Sachse | 2/12 |
| 3,820,164 | A | * | 6/1974 | Kiebala | 2/10 |
| 4,541,125 | A | * | 9/1985 | Phillips | 2/10 |
| 4,819,274 | A | * | 4/1989 | Day | 2/10 |
| 4,843,643 | A | * | 7/1989 | Parissenti et al. | 2/13 |
| 4,924,526 | A | * | 5/1990 | Parissenti et al. | 2/13 |
| 5,261,124 | A | * | 11/1993 | Day | 2/10 |
| 5,412,812 | A | * | 5/1995 | Gatchalian | 2/10 |
| 5,533,207 | A | * | 7/1996 | Diaz | 2/10 |
| 5,533,208 | A | * | 7/1996 | Tonoyan et al. | 2/10 |
| 5,669,071 | A | * | 9/1997 | Vu | 2/10 |
| 5,687,420 | A | * | 11/1997 | Chong | 2/10 |
| 5,689,827 | A | * | 11/1997 | Ryder | 2/10 |
| 5,692,234 | A | * | 12/1997 | Yuen | 2/10 |
| 5,692,522 | A | * | 12/1997 | Landis | 128/857 |
| 5,819,311 | A | * | 10/1998 | Lo | 2/12 |
| 6,088,837 | A | * | 7/2000 | Baker | 2/195.1 |
| 6,237,147 | B1 | * | 5/2001 | Brockman | 2/10 |
| 6,491,390 | B1 | * | 12/2002 | Provost | 351/155 |
| 7,343,630 | B2 | * | 3/2008 | Lee | 2/175.6 |
| 2008/0109927 | A1 | * | 5/2008 | Grilliot et al. | 2/10 |
| 2009/0094720 | A1 | * | 4/2009 | Stachler et al. | 2/5 |

OTHER PUBLICATIONS

Merriam-Webster Online Dictionary, "Mold", Aug. 29, 2012, <http://www.merriam-webster.com/dictionary/mold>, 1 pg.*

U.S. Appl. No. 11/974,654, filed Oct. 15, 2007, Stachler et al.

U.S. Appl. No. 12/157,457, filed Jun. 11, 2008, Stachler et al.

U.S. Appl. No. 12/157,539, filed Jun. 11, 2008, Stachler et al.

* cited by examiner

EYE PROTECTORS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention pertains to eye protectors for use with a helmet for a firefighter or other emergency rescue worker.

BACKGROUND OF THE INVENTION

Commonly, a helmet for a firefighter or for an industrial, chemical, or emergency rescue worker has a crown and a brim, which projects forwardly from the crown and which may project in other directions from the crown. Commonly, the helmet is equipped with a pair of eye shields, one for each eye of a wearer, and each of the pair of eye shields is adapted to be manually moved between a storage position and a usage position. In the usage position, but not in the storage position, the eye shield projects downwardly so as to shield a given eye of a wearer against sparks, liquids, particles, and other objects striking the front of the eye shield.

An example of an eye shield, as described in the preceding paragraph, is disclosed in U.S. Pat. No. 3,383,155 to Lester T. Bourke. As disclosed in U.S. Pat. No. 3,383,155, the disclosure of which is incorporated herein by reference, each of the pair of eye shields is mounted to a helmet, beneath a brim projecting forwardly from a crown of the helmet, and each of the pair of eye shields is adapted to be manually flipped between the storage and usage positions and is stable in either of the storage and usage positions. Similar eye shields are available commercially from various sources including Morning Pride Manufacturing, L.L.C. of Dayton, Ohio. While these shields have performed well for their intended purpose, there is always room for improvement.

SUMMARY OF THE INVENTION

In accordance with one feature of the invention, an eye protector is provided for mounting to a protective helmet for use by a firefighter or other emergency worker, the protective helmet having a brim. The eye protector includes a bracket mounted to the brim, the bracket including a first stop surface; and an eye shield attached to the bracket for movement between a storage position extending along the brim and a usage position extending downward from the brim to shield the eye of a wearer, the eye shield including a second stop surface that abuts the first stop surface with the eye shield in the usage position to limit movement of the eye shield beyond the usage position.

As one feature, the first stop surface and the bracket are a unitary molding.

In one feature, the second stop surface and the eye shield are a unitary molding.

According to one feature, the second stop surface is located adjacent a lateral side of the eye shield.

As one feature, the first stop surface is located on a protrusion extending downward from the bracket toward the eye shield.

In one feature, the second stop surface is located on a protrusion extending upward from the eye shield toward the bracket with the eye shield in the usage position.

In accordance with one feature of the invention, an eye protector is provided for mounting to a protective helmet for use by a firefighter or other emergency worker, the protective helmet having a brim. The eye protector includes a bracket mounted to the brim, the bracket including a pair of first stop surfaces; and a pair of eye shields attached to the bracket for movement between a storage position extending along the brim and a usage position extending downward from the brim to shield the eye of a wearer, each eye shield including a second stop surface that abuts the first stop surface with the eye shield in the usage position to limit movement of the eye shield beyond the usage position.

According to one feature, the first stop surfaces and the bracket are a unitary molding.

As one feature, for each eye shield, the second stop surface and the eye shield are a unitary molding.

In one feature, each of the second stop surfaces is located adjacent a lateral side of the corresponding eye shield.

As one feature, each of the first stop surfaces is located on a protrusion extending downward from the bracket toward the eye shield.

According to one feature, the first stop surfaces are located on a common protrusion located centrally on the bracket between the eye shields.

In one feature, each second stop surface is located on a protrusion extending upward from the corresponding eye shield toward the bracket with the eye shield in the usage position.

In accordance with one feature of the invention, an eye protector is provided for mounting to a protective helmet for use by a firefighter or other emergency worker, the protective helmet having a brim. The eye protector includes a bracket mounted to the brim, a first stop surface carried on the bracket, an eye shield attached to the bracket for movement between a storage position extending along the brim and a usage position extending downward from the brim to shield the eye of a wearer, and a second stop surface carried on the eye shield and abutted against the first stop surface with the eye shield in the usage position to limit movement of the eye shield beyond the usage position.

As one feature, the first stop surfaces is a unitary part of the bracket.

According to one feature, the second stop surface is a unitary part of the eye shield.

In one feature, the second stop surface is located adjacent a lateral side of the eye shield.

As one feature, the first stop surface is located on a protrusion extending downward from the bracket toward the eye shield.

In one feature, the second stop surface is located on a protrusion extending upward from the eye shield toward the bracket with the eye shield in the usage position.

In accordance with one feature of the invention, an eye protector is provided for mounting to a protective helmet for use by a firefighter or other emergency worker, the protective helmet having a brim. The eye protector includes a bracket mounted to the brim, a pair of first stop surfaces carried on the bracket, a pair of eye shields attached to the bracket for movement between a storage position extending along the brim and a usage position extending downward from the brim to shield the eye of a wearer, and a pair of second stop surfaces, each of the second stop surfaces carried on a corresponding one of the eye shields and abutted against a corresponding one of the first stop surfaces with the corresponding eye shield in the usage position to limit movement of the eye shield beyond the usage position.

As one feature, the first stop surfaces and the bracket are a unitary molding.

In one feature, for each eye shield, the second stop surface is a unitary part of the eye shield.

According to one feature, each of the second stop surfaces is located adjacent a lateral side of the corresponding eye shield.

As one feature, each of the first stop surfaces is located on a protrusion extending downward from the bracket toward the eye shield. In a further feature, the first stop surfaces are located on a common protrusion located centrally on the bracket between the eye shields.

According to one feature, each second stop surface is located on a protrusion extending upward from the corresponding eye shield toward the bracket with the eye shield in the usage position.

Other objects, features, and advantages of the invention will become apparent from a review of the entire specification, including the appended claims and drawings.

DETAILED DESCRIPTION OF THE PREFERRED EMBODIMENT

Figure 1:
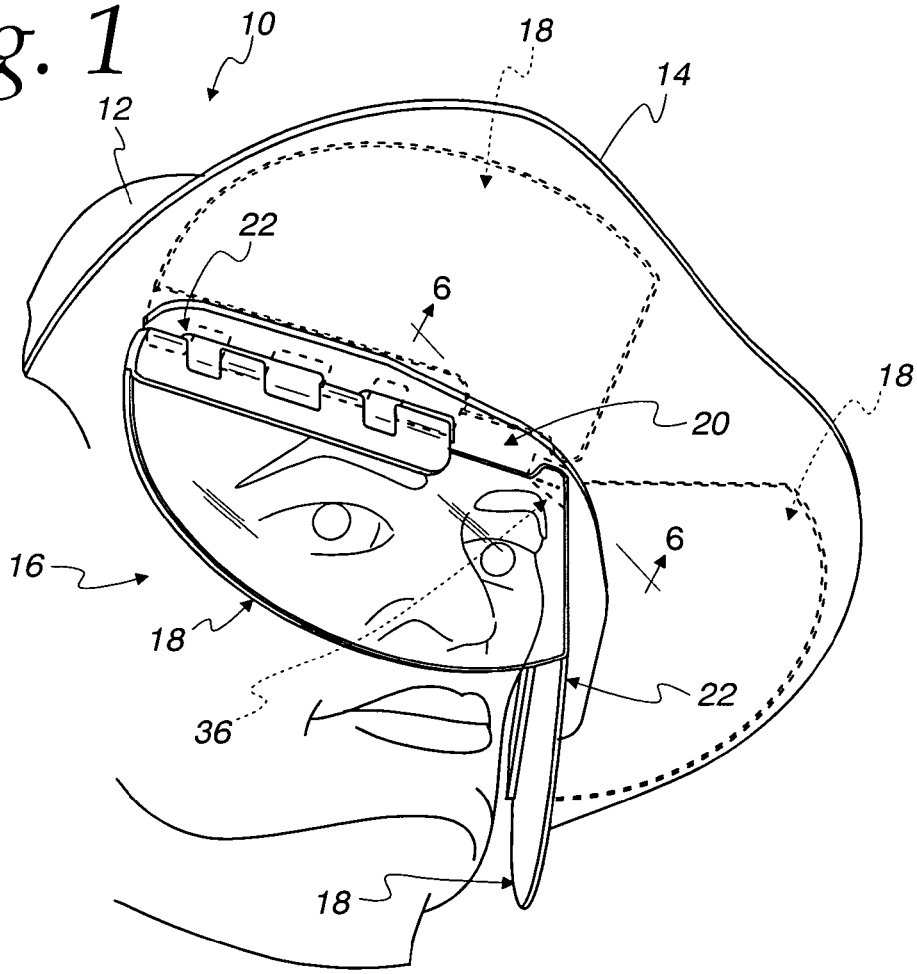
FIG. 1 is a fragmentary, perspective view looking upward toward the front of a helmet equipped with an eye protector embodying the invention.

As shown in FIG. 1, a protective helmet 10 of the type worn by a firefighter or other emergency worker has a crown 12 and a brim 14 that projects forwardly and laterally from the lower part of the crown 12. An eye protector 16 is provided on the helmet 10 in the form of a pair of transparent eye resistant eye shields 18 that are mounted to the underside of the brim 14 by a bracket 20 for manual movement between a storage position and a usage position. The shields 18 are shown in the usage position in FIG. 1, with each shield 18 extending downward from the brim 14 to shield the eyes of a wearer against sparks, liquids, particles, and other such objects which will strike the front of the shields 18 rather than the eyes of a wearer. In the storage position, each of the shields 18 project forwardly along and beneath the brim 14, as shown in phantom in FIG. 1.

As shown generally at 22, a hinge is provided to pivotably connect each eye shield 18 to the bracket 20 for movement between the storage and usage position. In this regard, with reference to the embodiment of the eye protector 16 shown in FIGS. 2 and 3, each of the eye shields 18 (only one shown in FIG. 3) includes a journal 24 in the form of a plurality of cylindrical elements 26. Preferably, each of the cylindrical elements 26 is separated by a spacer element 28, with shoulders 30 provided on the ends of the spacer elements 28 transverse to the longitudinal axis A of the cylindrical elements 26. The bracket 20 includes having a plurality of bearing surfaces 32 defined in snap fit connectors or hinge elements 34 on the bracket 20, with each of the bearing surfaces 32 having a U-shaped or cylindrical-shaped transverse cross-section that is shaped to receive and conform to a corresponding one of the cylindrical elements 26. Shoulders 35 are provided on the ends of each of the connector elements 34 transverse to the longitudinal axis B. Together, the journals 24 and the snap fit connector elements 34, and their associated features, form the hinges 22 for the shields 18.

Figure 2:
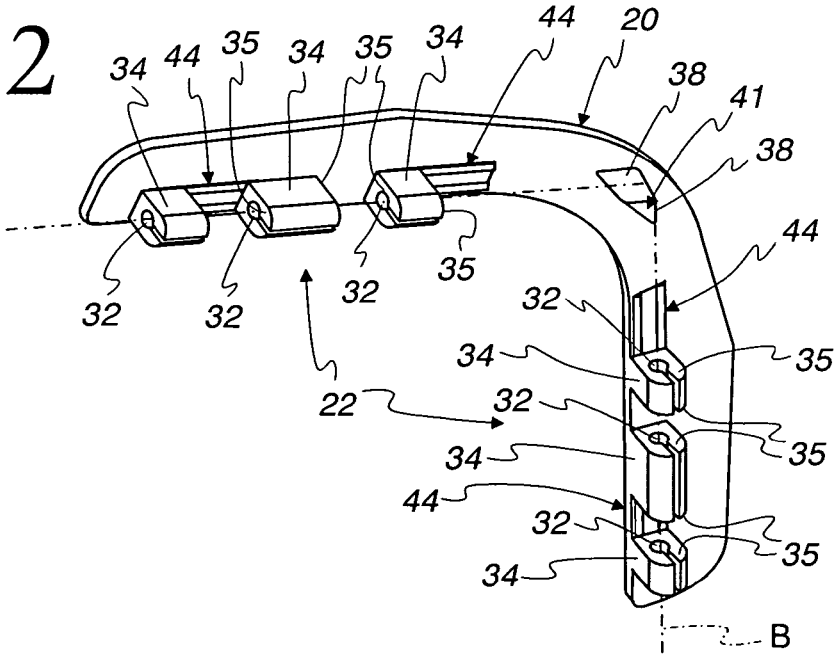
FIG. 2 is a perspective view of a bracket component of the eye protector of FIG. 1.
Figure 3:
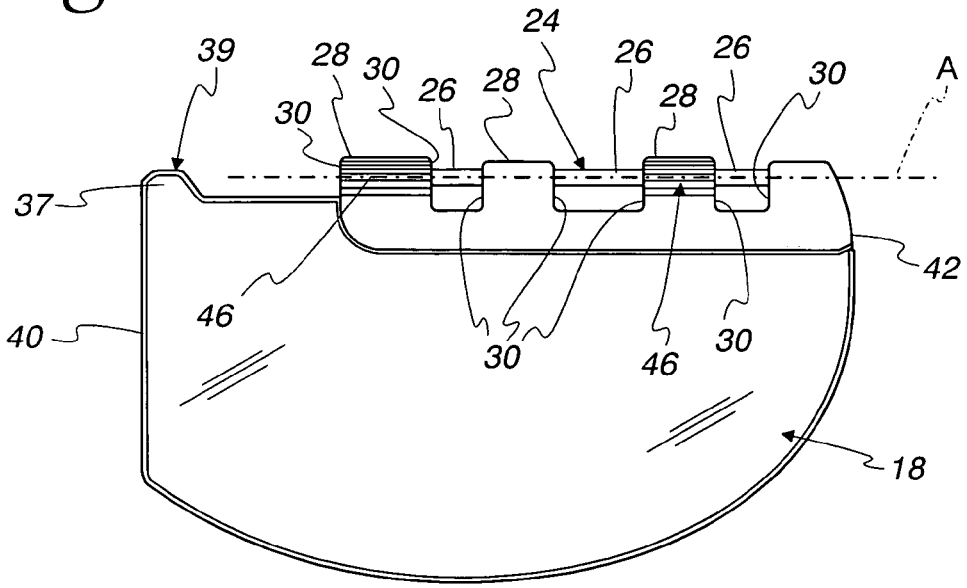
FIG. 3 is a front view of an eye shield of the eye protector of FIG. 1.
Figure 6:
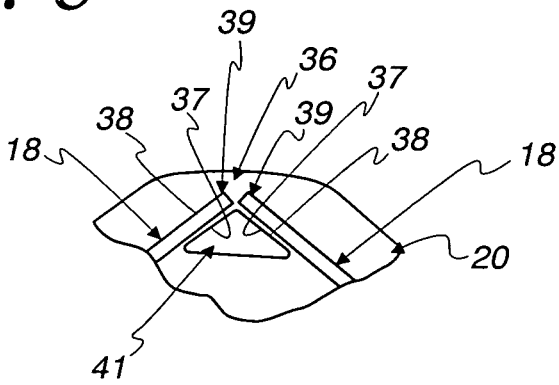
FIG. 6 is a partial plan view taken from line 6-6 in FIG. 1.

As best seen in FIGS. 2, 3 and 6, a stop mechanism 36 is provided in the form of stop surfaces 37 on each of the eye shields 18 that abut corresponding stop surfaces 38 carried on the bracket 20 with the eye shield 18 in the usage position to limit movement of the eye shield 18 beyond the usage position. As best seen in FIG. 3, each of the stop surfaces 37 is located on a protrusion 39 that extends upward from the eye shield 18 toward the bracket 20 with the eye shield 18 in the usage position, and which is located adjacent an inner lateral side 40 of the eye shield 18. As best seen in FIGS. 2 and 6, the stop surfaces 38 are located on a common protrusion 41 carried by the bracket 20 at a central location between the eye shields 18 and extend downward towards the eye shields 18.

In the embodiment of FIGS. 2 and 3, each of the eye shields 18 is a one piece, unitary construction with each of the cylindrical elements 26, spacer elements 28, protrusion 39, and stop surface 37 formed as a unitary part of the eye shield 18, preferably by a suitable forming process, such as suitable molding and/or machining process. Similarly, the bracket 20 is a one piece, unitary construction with the features 32, 34, 36, 38 and 41 being formed as a unitary part of the bracket 20 using a suitable forming process, such as a suitable molding and/or machine process. Additionally, as best seen in FIG. 3, it may be desirable for the areas 42 adjacent the cylindrical elements 26 and spacer elements 28 to be of a thicker cross section than the remainder of the eye shield 18 to improve the structural integrity of the eye shield 18.

As best seen in FIG. 2, the bracket also preferably includes one or more frictional lock features 44 that engage corresponding lock features 46, best seen in FIG. 3, on the shields 18 in both the usage and storage positions to retain the eye shields 18 in each position.

Figure 4:
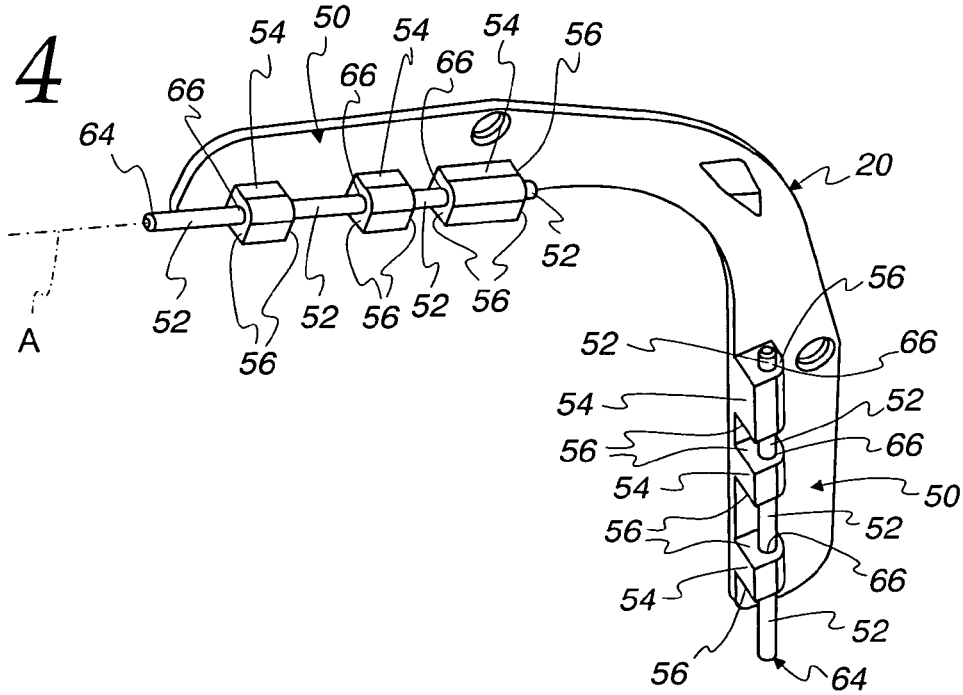
FIG. 4 is a perspective view of another embodiment of a bracket of the eye protector of FIG. 1.
Figure 5:
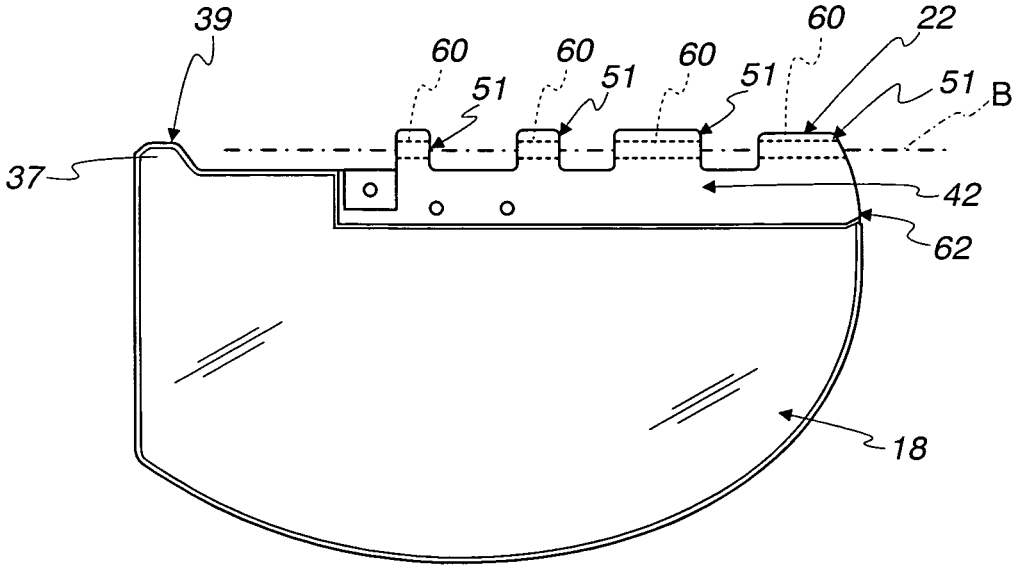
FIG. 5 is a front view of another embodiment of an eye shield of the eye protector of FIG. 1.

FIGS. 4 and 5 illustrate another embodiment of the eye protector 16 wherein the bracket 20 includes a pair of journals 50, each journal 50 to be received in a plurality of snap fit connector elements 51 carried on a corresponding one of the eye shields 18 to form the corresponding hinge 22. Each of the journals 50 is provided in the form of a plurality of cylindrical elements 52, with each of the cylindrical elements 52 being separated by a spacer element 54, with shoulders 56 provided on the ends of the spacer elements 54 transverse to the longitudinal axis A of the cylindrical elements 52. Each of the snap fit connector elements 51 includes a plurality of bearing surfaces 60 on the corresponding eye shield 18, with each of the bearing surfaces 60 having a U-shaped or cylindrical-shaped transverse cross-section that is shaped to receive and conform to a corresponding one of the cylindrical elements 52.

While the embodiments of FIGS. 4 and 5 can be formed as one piece, unitary constructions in the same manner as described for the embodiments of FIG. 3, an alternate construction is illustrated in FIGS. 4 and 5 wherein the connector elements 51 are formed as part of a separate component 62 that is then bonded or fastened to a unitary piece that forms the remainder of the eye shield 18. For the bracket 20, the cylindrical elements 52 are defined by a pair of cylindrical rods 64, that are interference fit through conforming cylindrical openings 66 formed in each of the spacer elements 54.

It should be understood that the various embodiments shown and described herein, particularly for the hinge 22, are illustrations of preferred embodiments, and that other configurations are possible for use with the disclosed stop mechanism 36. For example, while the hinges 22 have been described in connection with snap fit connector elements 34 and 51, in some applications it may be desirable for simple axial bores to be used in connection with a hinge pin. Similarly, while the protrusion 39 and stop surface 37 have been shown as a unitary part of the eye shield 18 in both embodiments, in some applications it may be desirable for these features to be part of a separate component that is attached to the eye shield 18, similar to the components 62 of FIGS. 4 and 5. In this regard, for example, component 62 could be extended to include the protrusion 39 and surface 37. Similarly, while the protrusion 41 and surfaces 38 have been shown as a unitary part of the bracket 20, in some applications it may be desirable for these features to be formed as separate features or components that are attached to the bracket 20.

The invention claimed is:

1. An eye protector mountable to a protective helmet for use by a firefighter or other emergency worker, the protective helmet having a brim, the eye protector comprising:

a bracket mounted to the brim, the bracket including a pair of first stop surfaces; and a pair of eye shields attached to the bracket for movement between a storage position extending along the brim and a usage position extending downward from the brim to shield the eyes of a wearer, each eye shield including a second stop surface that abuts the first stop surface with the eye shield in the usage position to limit movement of the eye shield beyond the usage position;

the first stop surfaces are located on a single protrusion located centrally on the bracket between the eye shields, the first stop surfaces defining a V-shaped face on the single protrusion with one of the first stop surfaces defining one leg of the V-shaped face and the other of the first stop surfaces defining the other leg of the V-shaped face.

2. The eye protector of claim 1 wherein each second stop surface is located on a protrusion extending upward from the corresponding eye shield toward the bracket with the eye shield in the usage position.

3. An eye protector mountable to a protective helmet for use by a firefighter or other emergency worker, the protective helmet having a brim, the eye protector comprising:

a bracket mounted to the brim;

a pair of first stop surfaces carried on the bracket;

a pair of eye shields attached to the bracket for movement between a storage position extending along the brim and a usage position extending downward from the brim to shield the eyes of a wearer; and a pair of second stop surfaces, each of the second stop surfaces carried on a corresponding one of the eye shields and abutted against a corresponding one of the first stop surfaces with the corresponding eye shield in the usage position to limit movement of the eye shield beyond the usage position, wherein the first stop surfaces are located on a common protrusion located in the center of the bracket between the eye shields, the first stop surfaces defining a V-shaped face on the common protrusion.

4. The eye protector of claim 3 wherein for each eye shield, the second stop surface is a unitary part of the eye shield.

5. The eye protector of claim 3 wherein each of the second stop surfaces is located adjacent a lateral side edge of the corresponding eye shield.

6. The eye protector of claim 3 wherein each of the first stop surfaces is located on the common protrusion extending downward from the bracket toward the eye shield.

7. The eye protector of claim 3 wherein each second stop surface is located on a protrusion extending upward from the corresponding eye shield toward the bracket with the eye shield in the usage position.

* * * * *